US006454668B2

(12) United States Patent
Kasashima et al.

(10) Patent No.: US 6,454,668 B2
(45) **Date of Patent: *Sep. 24, 2002**

(54) GOLF BALL

(75) Inventors: Atsuki Kasashima; Keisuke Ihara; Kazuto Maehara, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 3 days.

This patent is subject to a terminal disclaimer.

(21) Appl. No.: 09/739,328

(22) Filed: Dec. 19, 2000

(30) Foreign Application Priority Data

Dec. 21, 1999 (JP) ..... 11-362593

(51) Int. Cl.[7] ..... A63B 37/12; A63B 37/14; A63B 37/00

(52) U.S. Cl. ..... 473/378; 473/383; 473/384; 473/351

(58) Field of Search ..... 473/351, 378, 473/379, 380, 381, 382, 383, 384

(56) References Cited

U.S. PATENT DOCUMENTS

| | | | | | |
|---|---|---|---|---|---|
| 5,033,750 | A | * | 7/1991 | Yamagishi et al. | 473/384 |
| 5,857,924 | A | * | 1/1999 | Miyagawa et al. | 473/365 |
| 5,902,193 | A | * | 5/1999 | Shimosaka et al. | 473/379 |
| 5,916,044 | A | * | 6/1999 | Shimosaka et al. | 473/377 |
| 6,039,660 | A | | 3/2000 | Kasahima et al. | 473/378 |

* cited by examiner

*Primary Examiner*—Steven Wong
*Assistant Examiner*—Alvin A. Hunter
(74) *Attorney, Agent, or Firm*—Sughrue Mion, PLLC

(57) ABSTRACT

In a dimpled golf ball, the parameters of dimples are optimized to improve the aerodynamic performance of the ball and thus increase its flight distance. The dimples have a planar shape which is circular, and are of at least three types of mutually differing diameter. At least one of the types of dimples has a cross-sectional shape differing from that of the other types. One of the dimple types may have a cross-sectional shape defined by the union of at least two concave portions of differing slope.

7 Claims, 4 Drawing Sheets

GOLF BALL

The present invention relates to a golf ball having excellent flight performance.

BACKGROUND OF THE INVENTION

Golf balls are provided on the surface with numerous planar circular depressions or dimples, in order to enhance their aerodynamic properties. It is well-known that, other factors being equal, golf balls with dimples fly better than golf balls which are smooth and have no dimples.

The distance traveled by a golf ball when hit with a golf club is determined by a number of factors, including the initial velocity of the ball, the drag and lift which act on the ball during its flight, the ball's spin rate, and also weather conditions, all of which complicate theoretical analyses aimed at increasing the flight distance.

A great deal of effort has been devoted to maximizing the effects by dimples associated with the shape parameters of a golf ball on enhancing the ball's flight characteristics, save for the initial velocity which is largely governed by the materials making up the ball. Innovations have included increasing the dimple diameter, using several types of dimples of differing diameter and thus size, increasing or reducing the dimple depth, and employing dimples of various planar shapes, ranging from circular to polygonal. Innovations relating specifically to the cross-sectional shape of the dimples have included round shapes (i.e., shapes representing the arc of a circle), composite shapes formed at by the superposition of a large and a small dimple, flat-bottomed shapes, and conical shapes. In addition, much experimentation has been done with the number of dimples on the ball's surface. Such efforts have achieved a certain degree of success.

The use in golf balls of dimples having the various above shapes has been subject to aesthetic constraints associated with the ball's appearance. Use is generally made of one type of dimple having a planar shape that is circular. Alternatively, where it is necessary to distribute the dimples over the ball's surface in a uniform and tight arrangement, several types of circular dimples of different diameter are used. In the latter case, although the dimples are of different diameter, their cross-sectional shapes are substantially similar.

However, because such innovations have yet to provide golf balls with a flight performance that matches the high expectations and skill level of professional golfers and other advanced players, there exists a desire for further development and improvement.

SUMMARY OF THE INVENTION

It is therefore an object of the invention to provide a golf ball in which the aerodynamic properties are improved by arraying, over the ball's surface, a combination of different types of dimples such as to impart the ball with a more complex surface geometry.

To attain this object, the invention provides a golf ball defining a substantially spherical surface on which a plurality of dimples are formed, each having a planar shape that is circular and a cross-sectional shape perpendicular thereto. The dimples are of at least three types including dimples of first, second and third types having small, medium and large diameters, respectively, in the planar circle. At least one of the at least three types of dimples has a cross-sectional shape differing from that of the other types of dimples. Such a golf ball, with its optimized dimple shape and optimized trajectory, has dramatically improved flight characteristics that enable it to satisfy the flight performance needs of even highly skilled golfers such as professionals. Moreover, the dimples on the inventive ball meet aesthetic requirements relating to the ball's appearance because they are all circular in shape.

Typically, each type of dimple has a different cross-sectional shape. According to a preferred embodiment of the invention, one type of dimple has a cross-sectional shape defined by the union, in a cross-sectional plane, of at least two concave portions of differing slope which meet at a point of inflection located at a position preferably at least half as deep as the maximum depth of the dimple.

There may be cases where, in trying to give the golf ball a more complex surface geometry by conferring one type of dimple with a cross-sectional shape differing from that of the other dimple types, such differentiation in the cross-sectional shape fails to have the desired effect. However, the inventor has found that such differences in the dimple cross-sectional shape are indeed effective if they are in accordance with another preferred embodiment of the invention, wherein the dimples of at least one type have a value TVo which differs by at least 0.03 from the TVo values for the other types of dimples. Herein, TVo is defined by the equation:

$$TVo=Vo/(0.058\ DM+0.677)$$

wherein Vo is the volume of space in the dimple below a planar surface circumscribed by the edge of the dimple divided by the volume of a cylinder whose base is the planar surface and whose height is the maximum depth of the dimple from the base, and DM is the diameter in millimeters of the planar surface circumscribed by the edge of the dimple (referred to herein as the "dimple diameter").

Preferably the golf ball of the invention has no great circle on the surface thereof which does not intersect with a dimple.

BRIEF DESCRIPTION OF THE DRAWINGS

The above and other objects, features and advantages of the invention will become more apparent from the following detailed description in conjunction with the attached drawings.

DETAILED DESCRIPTION OF THE INVENTION

Figure 1:
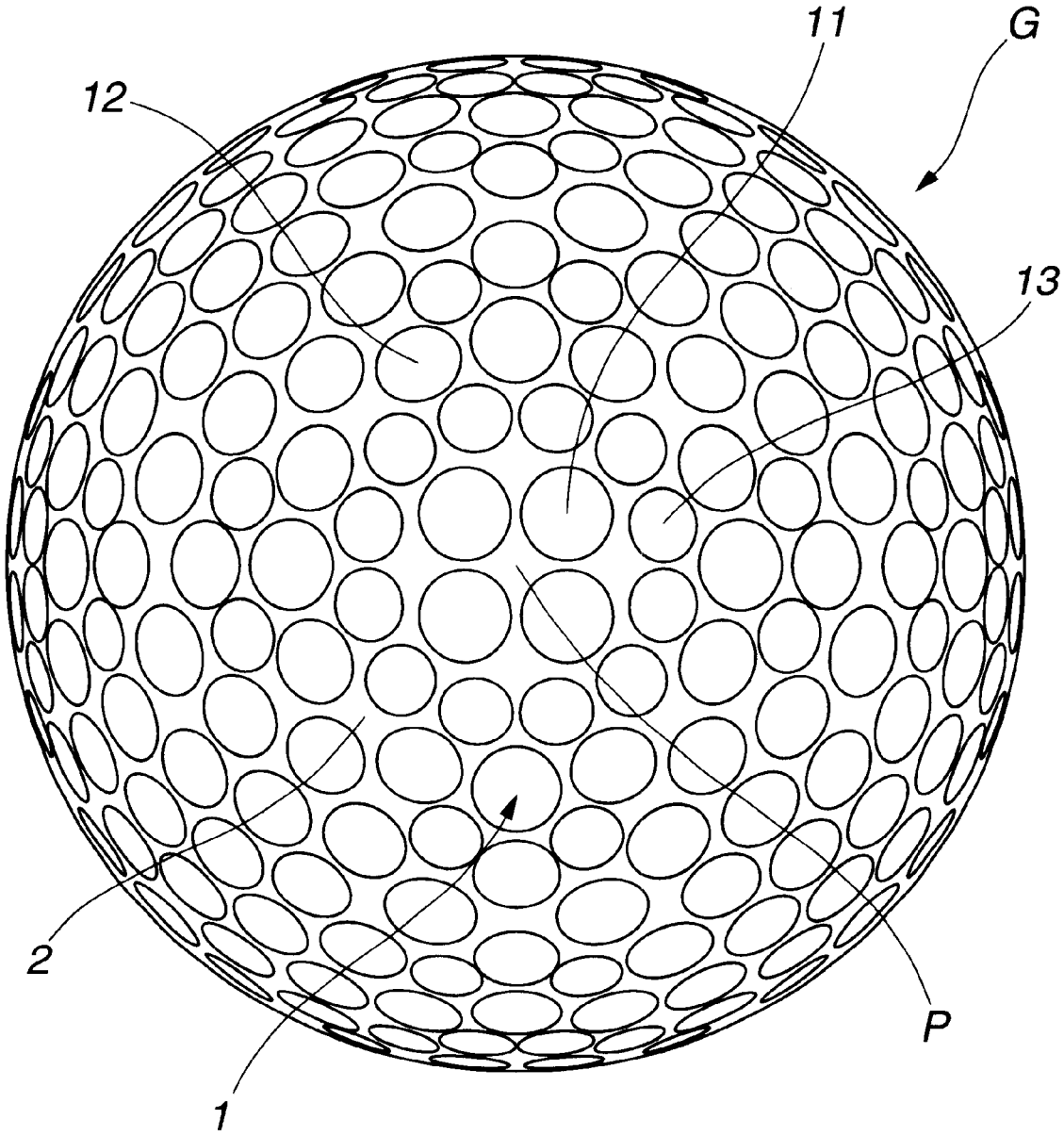
FIG. 1 shows an exemplary arrangement of dimples on a golf ball.
Figure 2:
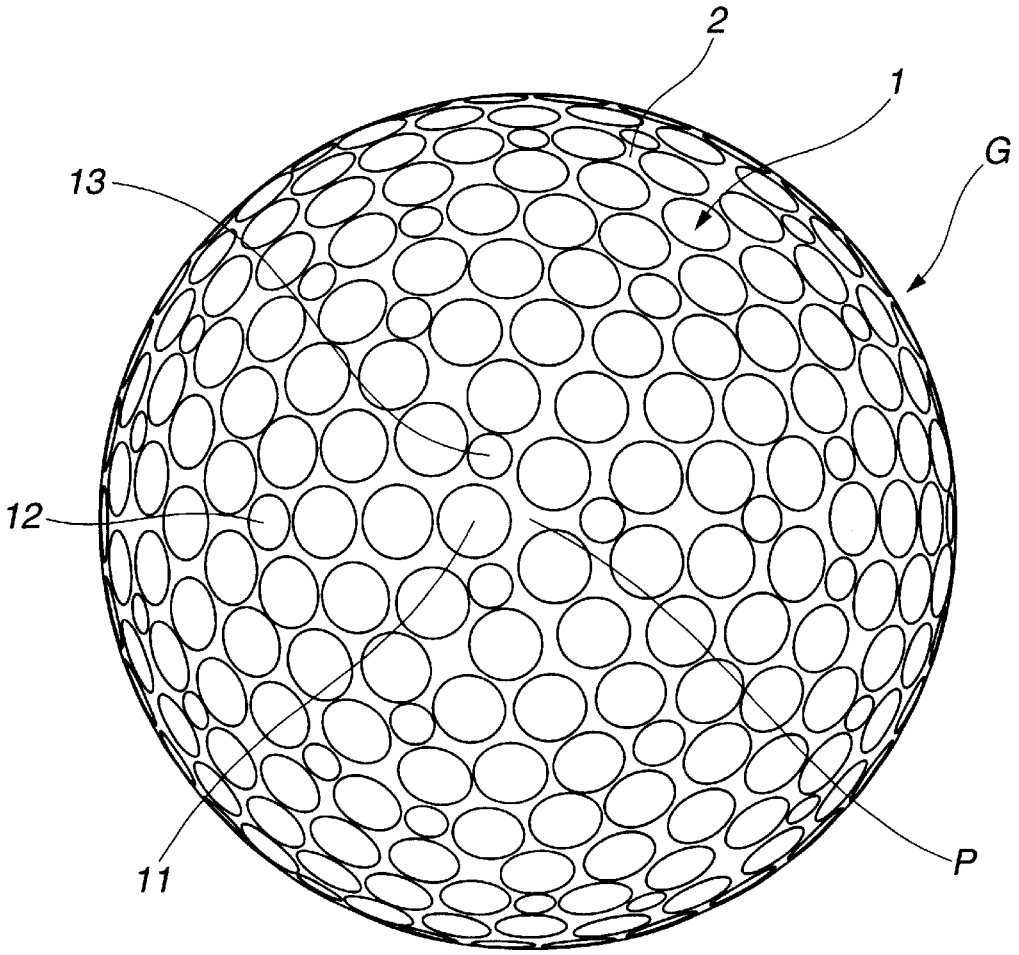
FIG. 2 shows another exemplary arrangement of dimples on a golf ball.

FIGS. 1 and 2 show examples of dimple arrangements on golf balls according to the present invention. Each of the two diagrams is a plan view of a golf ball G centered on a pole P. The golf ball G has a substantially spherical surface on which are formed a plurality of planar circular depressions or dimples 1. The remaining regions of the spherical surface between the dimples 1 are land areas 2.

The golf ball G shown in FIG. 1 is an embodiment of the invention in which the surface bears three types of circular dimples 1 comprising 72 large-diameter dimples 11, 216 medium-diameter dimples 12, and 104 small-diameter dimples 13. The total of 392 dimples are distributed in a substantially uniform manner over the surface. The three types of dimples are in a regular octahedral arrangement.

The golf ball G shown in FIG. 2 is an embodiment of the invention in which the surface likewise bears three types of dimples comprising 360 large-diameter dimples 11, 12 medium-diameter dimples 12, and 60 small-diameter dimples 13. The total of 432 dimples are distributed in a substantially uniform manner over the surface. The three types of dimples are in a regular icosahedral arrangement.

The dimples in the invention are not limited only to three types of large, medium, or small diameter as shown in FIGS. 1 and 2. That is, the surface of any one golf ball G must have on it at least three types of dimples, and generally has from 3 to 6 types of dimples.

In the invention, the dimples of at least one of the three or more types of dimples of differing diameter have a cross-sectional shape which differs from that of the other types of dimples. Regarding the use herein of the terms "same" and "different" with reference to the cross-sectional shape of dimples, when the cross-sectional shapes of different types of dimples are compared, dimples of similar cross-sectional shape are referred to as having "the same" cross-sectional shape, and dimples of dissimilar cross-sectional shape are referred to as having "different" cross-sectional shapes.

Referring to FIGS. 3 to 6, the cross-sectional shape of the dimples of the invention is explained. FIGS. 3 to 6 are enlarged views of exemplary dimple cross-sectional shapes suitable for achieving the objects of the invention. It is noted that the cross-sectional plane depicted in these figures is perpendicular to the planar surface F circumscribed by the dimple edge 3 which will be described later.

Figure 3:
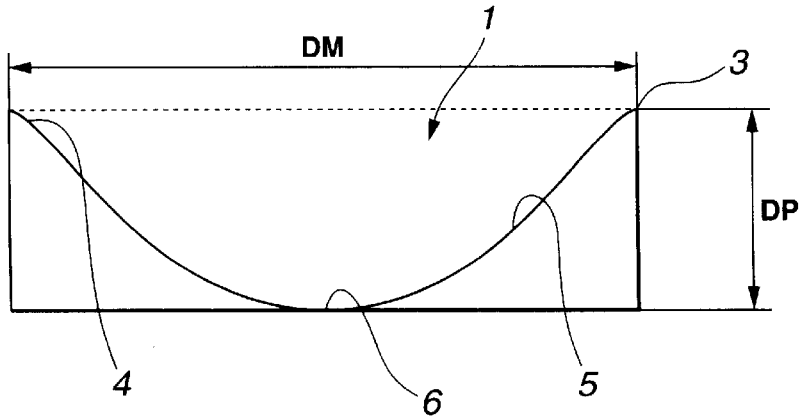
FIG. 3 is an enlarged cross-sectional view showing a dimple having a round shape according to one embodiment of the invention.

FIG. 3 shows a round dimple cross-sectional shape which successively connects, in the shape of an arc, one edge 3 at the dimple top, a shoulder 4, a sidewall 5, a bottom 6, the other sidewall 5, the other shoulder 4, and the other edge 3. Note that the edge 3 serves as a reference point for determining the dimple diameter and depth to be described later. The two shoulders 4 adjacent and continuous with the top ends of the two sidewalls 5 each form an upwardly convex shape which passes through the respective edge 3 and connects to the adjoining land area (not shown).

Figure 4:
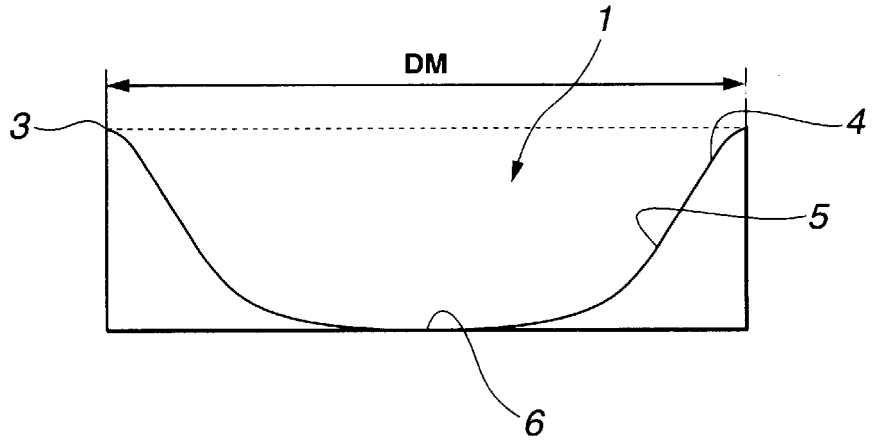
FIG. 4 is an enlarged cross-sectional view showing a dimple having a flat-bottomed shape according to another embodiment of the invention.
Figure 5:
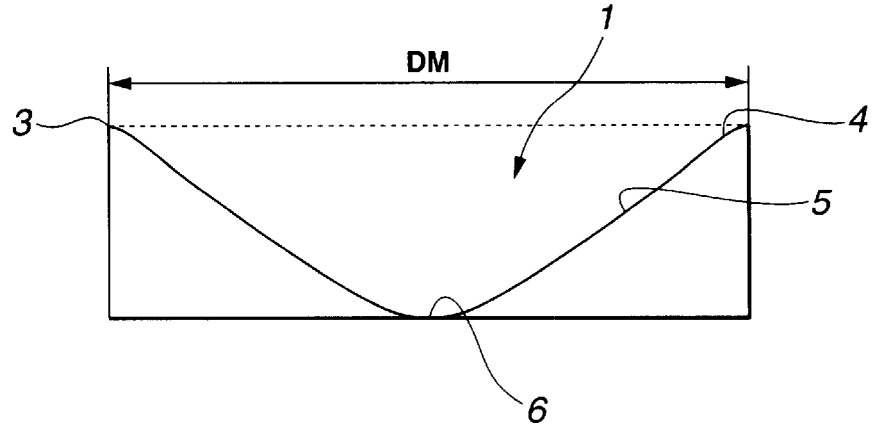
FIG. 5 is an enlarged cross-sectional view showing a dimple having a conical shape according to yet another embodiment of the invention.
Figure 6:
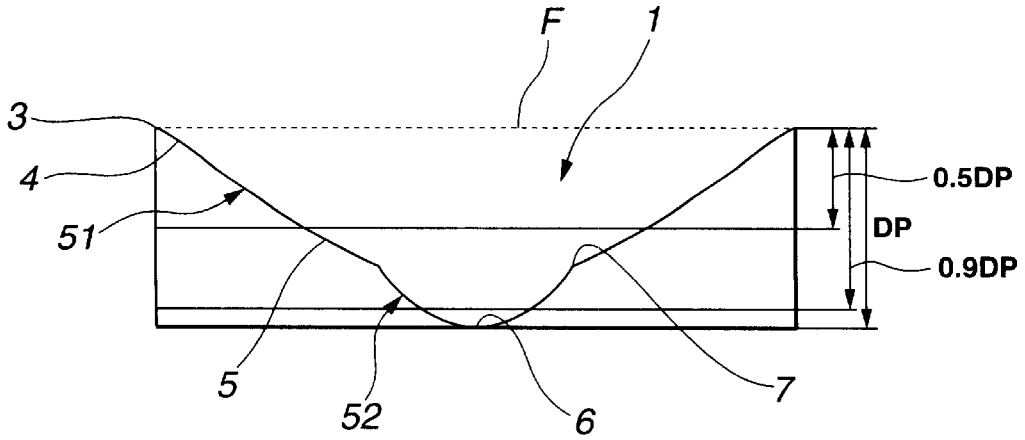
FIG. 6 is an enlarged cross-sectional view showing a dimple having a composite shape according to a still further embodiment of the invention.

The dimple cross-sections shown in FIGS. 4 to 6 similarly comprise a dimple edge 3, followed in turn by a shoulder 4, a sidewall 5, a bottom 6, the other sidewall 5, the other shoulder 4 and the other edge 3. Although the same reference numerals are used in these latter diagrams as in FIG. 3, portions of the shapes depicted in each differ as described below.

FIG. 4 shows a flat-bottomed dimple cross-sectional shape in which the sidewalls 5 descend more steeply to a broad bottom region 6.

FIG. 5 shows a conical dimple cross-sectional shape which is the opposite of that in FIG. 4. Namely, the sidewalls 5 extend at a gentle slope down to a relatively "pointed" and narrow bottom region 6.

FIG. 6 shows an example of a composite, in this case "double," dimple cross-sectional shape defined by the superposition of a first concave portion 51 and a second concave portion 52 of differing sidewall 5 shapes.

More specifically, the dimple shape in FIG. 6 comprises a first concave portion 51 defined by an outwardly extending curve of large arc in combination with a second concave portion 52 which is connected to the first concave portion 51 through an inwardly jutting "shoulder" and is defined by an outwardly extending curve of relatively small arc. The two portions are connected through the inwardly jutting shoulder 7 which is referred to as a point of inflection. The bottom 6 of the dimple in FIG. 6 is relatively narrow as in the case of the dimple of conical cross-section shown in FIG. 5.

In a dimple of a composite shape as shown in FIG. 6, the point of inflection 7 where the differing portions join is preferably at a position at least half as deep as the maximum dimple depth DP, defined herein as the greatest depth from the planar surface circumscribed by the edge of the dimple. More preferably the point of inflection 7 is at a position from 0.5 DP to 0.9 DP, and most preferably from 0.6 DP to 0.8 DP, spaced from the edge planar surface.

The type of dimple shown in FIG. 6 is an example of a dimple having a cross-sectional shape which is a composite of two concave portions of differing shape. In this example, the first portion 51 having a cross-sectional shape like that shown in FIG. 3 is united with the second portion 52 having a cross-sectional shape like that shown in FIG. 5.

As noted above, the golf ball of the invention is comprised of at least three types of dimples. Each type of dimple generally has a cross-sectional shape like one of those shown in FIGS. 3 to 6. At least one type of dimple must have a cross-sectional shape unlike the cross-sectional shapes of the other dimple types.

Thus, according to a typical embodiment of the inventive golf ball, dimples with a round cross-sectional shape like that shown in FIG. 3 may be used as the small-diameter and medium-diameter dimples, and dimples of another cross-sectional shape, such as the composite shape shown in FIG. 6, the conical shape shown in FIG. 5, or the flat-bottomed shape shown in FIG. 4 may be used as the large-diameter dimples.

In the practice of the invention, it is preferable for each type of dimple to have a different cross-sectional shape. Accordingly, it is recommended that each dimple type having a different diameter be given a different cross-sectional shape from among those shown in FIGS. 3 to 6, such that there is no duplication. For example, according to one preferred embodiment, the large-diameter dimples are given a composite cross-sectional shape (FIG. 6), the medium-diameter dimples a flat-bottomed cross-sectional shape (FIG. 4), and the small-diameter dimples a round cross-sectional shape (FIG. 3).

Moreover, it is advantageous for one type of dimple to have a cross-sectional shape defined by the union of two or more concave portions of differing slope. A preferred example of a dimple having such a cross-sectional shape is a dimple with the earlier-described cross-sectional shape shown in FIG. 6, particularly one in which the point of inflection is at a position at least half as deep as the maximum depth DP of the dimple.

There may be cases where, in trying to impart an even more complex surface geometry to the golf ball bearing an arrangement of specific dimples by conferring as described above one type of dimple with a cross-sectional shape differing from that of the other dimple types, such differentiation in the cross-sectional shape fails to have the desired effect. However, it so happens that differentiation in the dimple cross-sectional shape can be made more clearly effective by having the difference in TVo value for one type of dimple differ from the TVo values for the other types of dimples by preferably at least 0.03 and especially at least 0.05, but preferably not more than 0.2, and especially not more than 0.15. The TVo value is calculated according to the formula:

$$TVo=Vo/(0.058\ DM+0.677)$$

wherein Vo is the value obtained when the volume of space in the dimple below a planar surface circumscribed by the edge of the dimple is divided by the volume of a cylinder whose base is the planar surface and whose height is the maximum depth of the dimple from the base, and DM is the diameter in millimeters of the planar surface circumscribed by the edge of the dimple (i.e., the dimple diameter).

Figure 7:
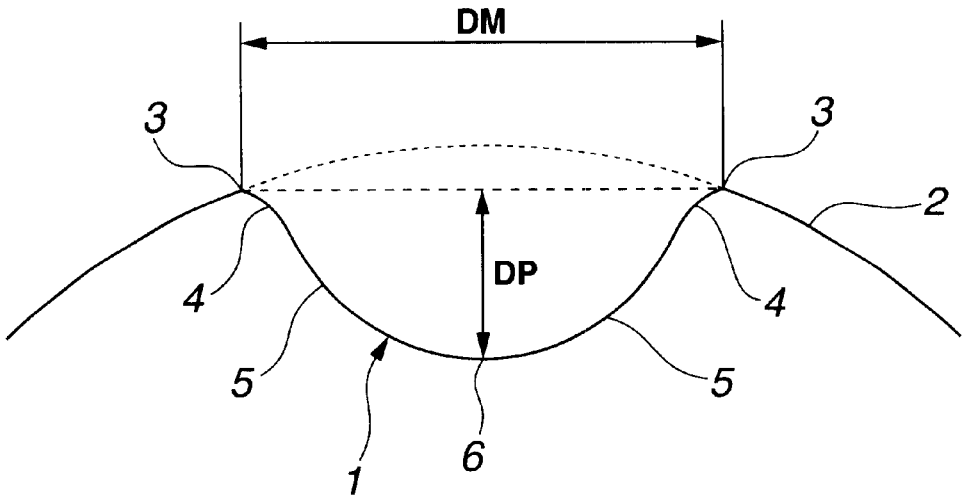
FIG. 7 schematically illustrates how the diameter and depth of a dimple are determined.
Figure 8:
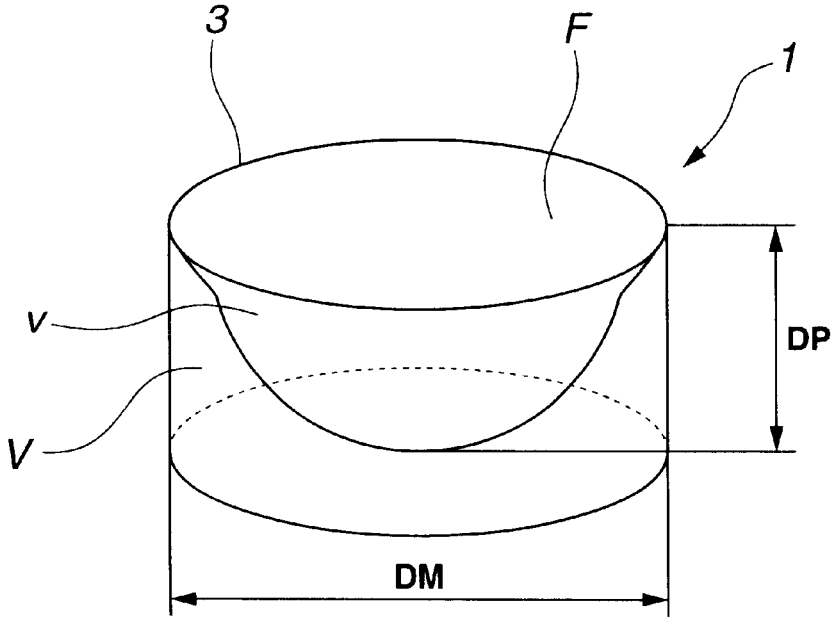
FIG. 8 schematically illustrates how the Vo value for a dimple is determined.

More specifically, referring to FIGS. 7 and 8, the above value Vo is defined as the value obtained when the volume of space "v" in the dimple below a planar surface F circumscribed by the edge 3 of the dimple is divided by the volume V of a cylinder whose base is the planar surface F and whose height is the maximum depth DP of the dimple from the base F. In this case, the maximum depth DP is set as appropriate for the dimple diameter, although it is generally preferable for it to be at least 0.05 mm, and especially at least 0.08 mm. The upper limit in the maximum depth DP is preferably not more than 0.4 mm, and especially not more than 0.3 mm.

It is noted that the dimple diameter DM is defined here as the diameter of the planar surface F circumscribed by the dimple edge 3; and the dimple edge 3 refers here to the boundary line between the dimple forming region and the land area of the ball surface.

It is recommended that the dimple diameter DM for each type of dimple be at least 1.5 mm, and preferably at least 2.0 mm, and not more than 6.0 mm, and preferably not more than 5.0 mm.

The dimples constituted as described above may be distributed over the surface of the golf ball according to any known dimple arrangement. Preferred is a dimple arrangement in which a great circle that does not intersect with one or more dimples is not available on the surface.

"Diameter" and "depth," as used herein, refer respectively to the diameter and depth of dimples in a golf ball obtained as a finished commercial product. Thus, in cases where the golf ball is painted, these terms refer to the dimple diameter and depth on the painted ball.

The art disclosed herein may be applied to any golf ball having dimples, including thread-wound golf balls, one-piece solid golf balls, two-piece solid golf balls, and multi-piece solid golf balls comprising three or more pieces. Characteristics of the golf balls such as weight and size may be set in accordance with the Rules of Golf.

EXAMPLE

Examples of the invention and comparative example are provided to illustrate the invention, and are not intended to limit the scope thereof.

Two-piece golf balls were manufactured by a conventional method from known materials. The golf balls in each example were of identical materials and construction, differing only in their dimple shapes, as shown in Tables 1 and 2.

Using a swing robot, the golf balls were hit with No. 1 wood at a head speed of 45 m/s. The flight performance of each ball was investigated. The results are shown in Table 3.

TABLE 1

| | Dimple parameters | | | | | | |
|---|---|---|---|---|---|---|---|
| | Type | Number of Dimples (Total number) | Diameter (mm) | Depth (mm) | Cross-sectional shape | Vo | TVo |
| Example 1 (FIG. 1) | D11 | 72 | 4.11 | 0.158 | round | 0.471 | 0.515 |
| | D12 | 216 | 3.92 | 0.153 | round/flat-bottomed* | 0.495 | 0.547 |
| | D13 | 104 | 3.30 | 0.132 | flat-bottomed | 0.502 | 0.578 |
| | | (392) | | | | | |
| Example 2 (FIG. 2) | D11 | 360 | 3.91 | 0.160 | double | 0.442 | 0.489 |
| | D12 | 12 | 2.95 | 0.121 | round | 0.472 | 0.557 |
| | D13 | 60 | 2.53 | 0.095 | round | 0.447 | 0.543 |
| | | (432) | | | | | |
| Comparative example (FIG. 1) | D11 | 72 | 4.11 | 0.165 | round | 0.482 | 0.527 |
| | D12 | 216 | 3.92 | 0.156 | round | 0.475 | 0.525 |
| | D13 | 104 | 3.30 | 0.132 | round | 0.452 | 0.520 |
| | | (392) | | | | | |

*dimples of fused cross-sectional shape in which the upper portion is round and the lower portion is flat-bottomed

TABLE 2

| | Difference between TVo values for: | | |
|---|---|---|---|
| | D11 and D12 | D12 and D13 | D13 and D11 |
| Example 1 | 0.032 | 0.031 | 0.063 |
| Example 2 | 0.068 | 0.014 | 0.054 |
| Comparative example | 0.002 | 0.005 | 0.007 |

TABLE 3

| | Carry (m) | Total (m) |
|---|---|---|
| Example 1 | 218 | 228 |
| Example 2 | 217 | 229 |
| Comparative example | 215 | 224 |

As will be appreciated from the preceding description and the results shown above, the golf balls of the invention bear optimized dimples and exhibit improved aerodynamic properties and increased flight distance.

Japanese Patent Application No. 11-362593 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball defining a substantially spherical surface on which are formed a plurality of dimples, each having a planar shape that is circular and a cross-sectional shape perpendicular thereto, the dimples being of at least three types including dimples of first, second and third types having small, medium and large diameters, respectively, in the planar circle; wherein at least one of the at least three types of dimples has a cross-sectional shape differing from that of the other types of dimples.

2. The golf ball of claim 1, wherein each type of dimple has a different cross-sectional shape.

3. The golf ball of claim 1, wherein one type of dimple has a cross-sectional shape defined by the union of at least two concave sections of differing slope in cross section.

4. The golf ball of claim 3, wherein the at least two concave portions of differing slope meet at a point of inflection whose position in the cross-sectional plane is at least half as deep as the maximum depth of the dimple.

5. The golf ball of claim 1, wherein the dimples of each type have a value TVo defined by the equation:

$$TVo=Vo/(0.058\ DM+0.677)$$

wherein Vo is the value obtained by dividing the volume of space in the dimple below a planar surface circumscribed by the edge of the dimple by the volume of a cylinder whose base is the planar surface and whose height is the maximum depth of the dimple from the base, and DM is the diameter in millimeters of the planar surface circumscribed by the edge of the dimple, the value TVo of at least one type of dimples differs by at least 0.03 from the values TVo for the other types of dimples.

6. The golf ball of claim 5, wherein the value TVo of at least one type of the dimples differs by at most 0.2 from the values TVo of the other type of the dimples.

7. The golf ball of claim 1, wherein the golf ball lacks on the surface thereof any great circle that does not intersect with dimples.

* * * * *